United States Patent [19]

Berkebile

[11] 4,426,561

[45] Jan. 17, 1984

[54] PUFFER-TYPE COMPRESSED-GAS CIRCUIT-INTERRUPTER

[75] Inventor: Lee E. Berkebile, Plum Borough, Pa.

[73] Assignee: Westinghouse Electric Corp., Pittsburgh, Pa.

[21] Appl. No.: 340,594

[22] Filed: Jan. 19, 1982

[51] Int. Cl.[3] ..... H01N 33/88

[52] U.S. Cl. ..... 200/148 A; 200/148 R

[58] Field of Search ..... 200/148 A, 150 G, 148 R

[56] References Cited

U.S. PATENT DOCUMENTS

| | | | |
|---|---|---|---|
| 2,429,311 | 10/1947 | Gay | 200/148 A |
| 3,551,623 | 12/1970 | Colclaser, Jr. et al. | 200/148 R |
| 3,786,215 | 1/1974 | Mauthe | 200/148 A |
| 3,987,262 | 10/1976 | Rostron | 200/148 A |
| 4,139,751 | 2/1979 | Rostron | 200/148 A |
| 4,219,712 | 8/1980 | Emmerich | 200/148 A |
| 4,276,456 | 6/1981 | Cromer et al. | 200/148 A |
| 4,371,766 | 2/1983 | Husar | 200/148 A |

FOREIGN PATENT DOCUMENTS 9446 2/1980 European Pat. Off. ..... 200/148 A

*Primary Examiner*—Robert S. Macon

*Attorney, Agent, or Firm*—M. S. Yatsko

[57] ABSTRACT

An improved puffer-type compressed-gas circuit interrupter includes a stationary tubular contact and a movable contact structure operably engageable with the stationary contact when the circuit interrupter is closed. A hollow nozzle directs a blast of compressed gas into the arc established between the stationary contact and the movable contact during opening. The nozzle in the interior thereof has a neck portion of predetermined diameter for directing the blast of compressed gas into the arc. The stationary contact has venting apertures therein of predetermined size and shape with at least a portion of the venting aperture means being within a predetermined section of the stationary contact. The stationary contact section has a length measured along the axis of the stationary contact equal to about three times the inside diameter of the stationary contact.

7 Claims, 5 Drawing Figures

PUFFER-TYPE COMPRESSED-GAS CIRCUIT-INTERRUPTER

BACKGROUND OF THE INVENTION

The present invention is related to puffer-type compressed-gas circuit-interrupters of the type in which only a single gas pressure is utilized within the interrupting container structure.

As is well known by those skilled in the art, the relative motion between an operating cylinder assembly and a cooperable piston achieves a desirable compression of gas therebetween, which compressed gas is utilized during arc interruption by generally forcing the compressed high-pressure gas through a movable nozzle structure to direct the high-pressure gas flow intimately into engagement with the established arc located within the movable nozzle structure to effect the arc's extinction.

The present invention relates to puffer-type circuit interrupters of the type set forth in U.S. Pat. No. 3,551,623, issued Dec. 29, 1970, to Colcaser et al. This patent shows the relative motion of a movable piston within a relatively stationary operating cylinder, with electromagnetic field coils energizing a companion movable piston, which is electrically repelled toward the first-mentioned movable piston, the latter being attached to, and movable with, a contact-operating rod.

Other patents disclosing different piston structures, are, for example, U.S. Pat. No. 2,429,311, issued Oct. 21, 1947 to Gay; U.S. Pat. No. 3,786,215, issued Jan. 15, 1974 to Mauphe; and U.S. Pat. No. 3,987,262, issued Oct. 19, 1976, to Rostron.

U.S. Pat. No. 4,139,751, issued Feb. 13, 1979, to Rostron et al. discloses a puffer-type circuit-interrupter having a movable operating cylinder assembly movable over a relatively-fixed piston structure. A high electrical withstand capability is accomplished by using a generous radius on the lower ends of external stationary main contact fingers, and by shrouding or shielding the stationary contact probe within the surrounding shield of the stationary contact fingers. Open venting ports are provided at the upper end of the stationary contact finger cluster to prevent stagnation of the hot arc gas flowing into the stationary contact finger cluster, which thereby permits the hot arcing gases to be blown away to ensure good interrupting performance and a high breakdown value.

Another puffer-type circuit-interrupter is disclosed in U.S. Pat. No. 4,276,456, issued June 30, 1981, to Cromer et al. The Cromer patent discloses an improved circuit interrupter having an improved double-flow operation. The Cromer patent utilizes flexible movable arcing contact fingers with a surrounding cylindrical guide-valve sleeve to prevent premature leakage of compressed gas through the longitudinal finger slots provided in the movable arcing contact fingers during the opening operation.

Another puffer-type circuit-interrupter is disclosed in U.S. Pat. No. 4,219,712, issued Aug. 26, 1980, to Emmerick. The Emmerick patent discloses an interrupter including a tubular stationary contact with vent apertures in the upper portion thereof.

Although the prior art interrupters generally work well, problems have been encountered with a stagnation region forming at the stationary contact due to poor gas flow through the contact.

SUMMARY OF THE INVENTION

An improved puffer-type circuit-interrupter is provided including stationary contact structure means comprising a stationary tubular arcing contact. Gas compression means is provided comprising a piston means and a cylinder means movable relative to each other to compress gas within the cylinder means. The cylinder means comprises a main cylinder slidably engageable with the piston means and a hollow elongated insulating nozzle affixed to the upper portion of the main cylinder. A movable contact structure comprises a movable arcing contact in axial alignment with the stationary tubular arcing contact. The movable arcing contact is engageable with the stationary tubular arcing contact when the interrupter is initially opened to restrict the flow of compressed gas from the interior of the cylinder means into the interior of the stationary tubular contact.

The hollow nozzle, in the interior thereof, has a neck portion of predetermined minimum diameter dividing the interior of the nozzle into a lower section and an upper section. The neck portion of the nozzle member engages the stationary contact during the initial opening of the interrupter to provide a partial hermetic seal for the lower section. The lower section directs a blast of compressed gas into the arc established between the stationary contact and the movable contact upon their separation during the opening of the interrupter.

The stationary tubular arcing contact has venting aperture means therein of predetermined size and shape with at least a portion of the venting aperture means being within a predetermined section of the stationary tubular contact. The predetermined stationary contact section has a length measured along the axis of the stationary tubular contact equal to three times the minimum inside diameter of the stationary tubular contact. The stationary contact section is positioned adjacent to the neck portion of the nozzle member when the interrupter is closed. This arrangement ensures that the gas discharged by the lower section may exhaust freely through the stationary tubular contact thereby eliminating any problem of stagnation of gas flow at the stationary contact.

BRIEF DESCRIPTION OF THE DRAWINGS

For better understanding of the invention, reference may be had to the accompanying drawings, exemplary of the invention, in which.

DESCRIPTION OF THE PREFERRED EMBODIMENTS

Figure 1:
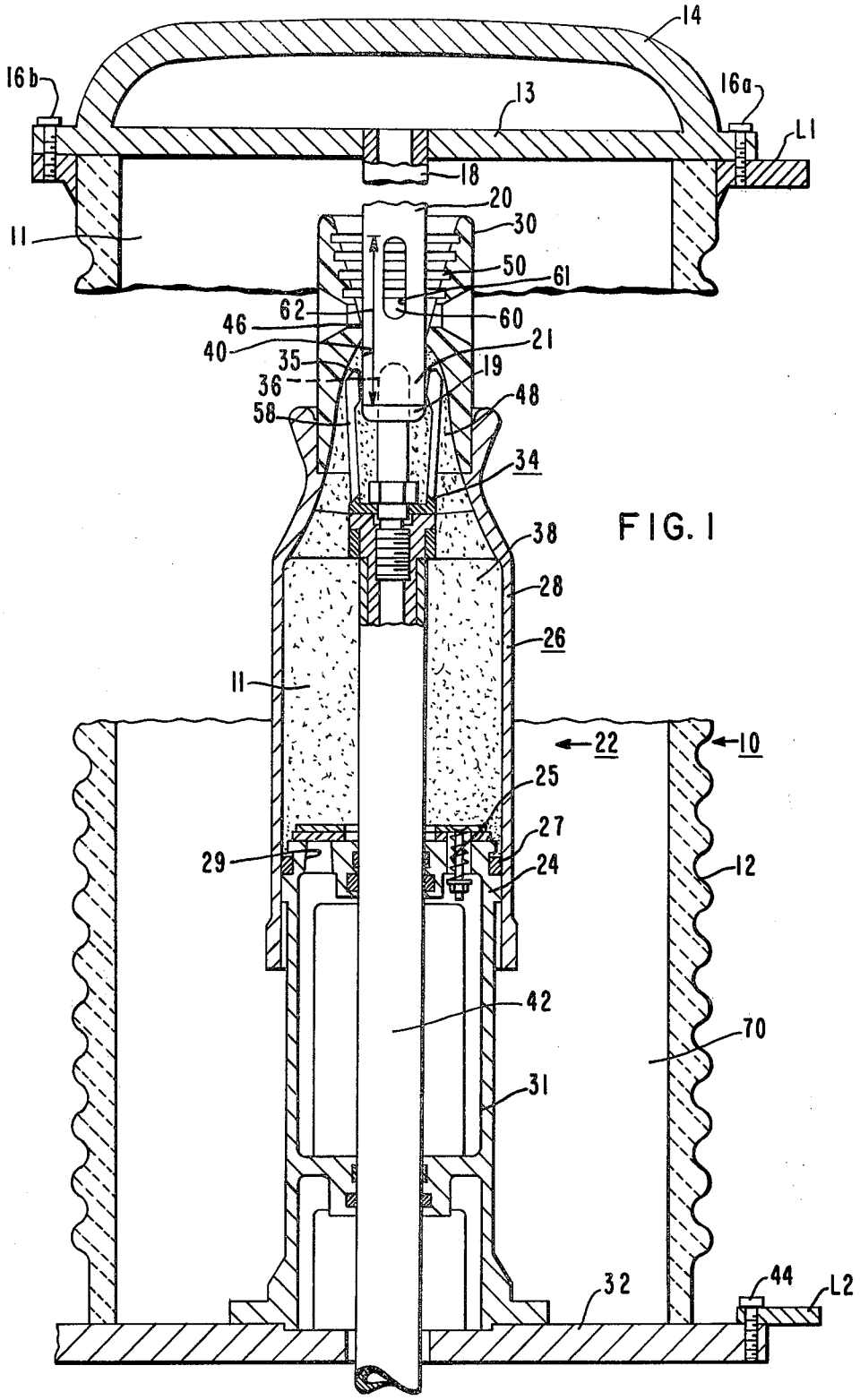
FIG. 1 is an elevational sectional view of a single-flow puffer-type circuit-interrupter of the present invention in the closed circuit position.
Figure 2:
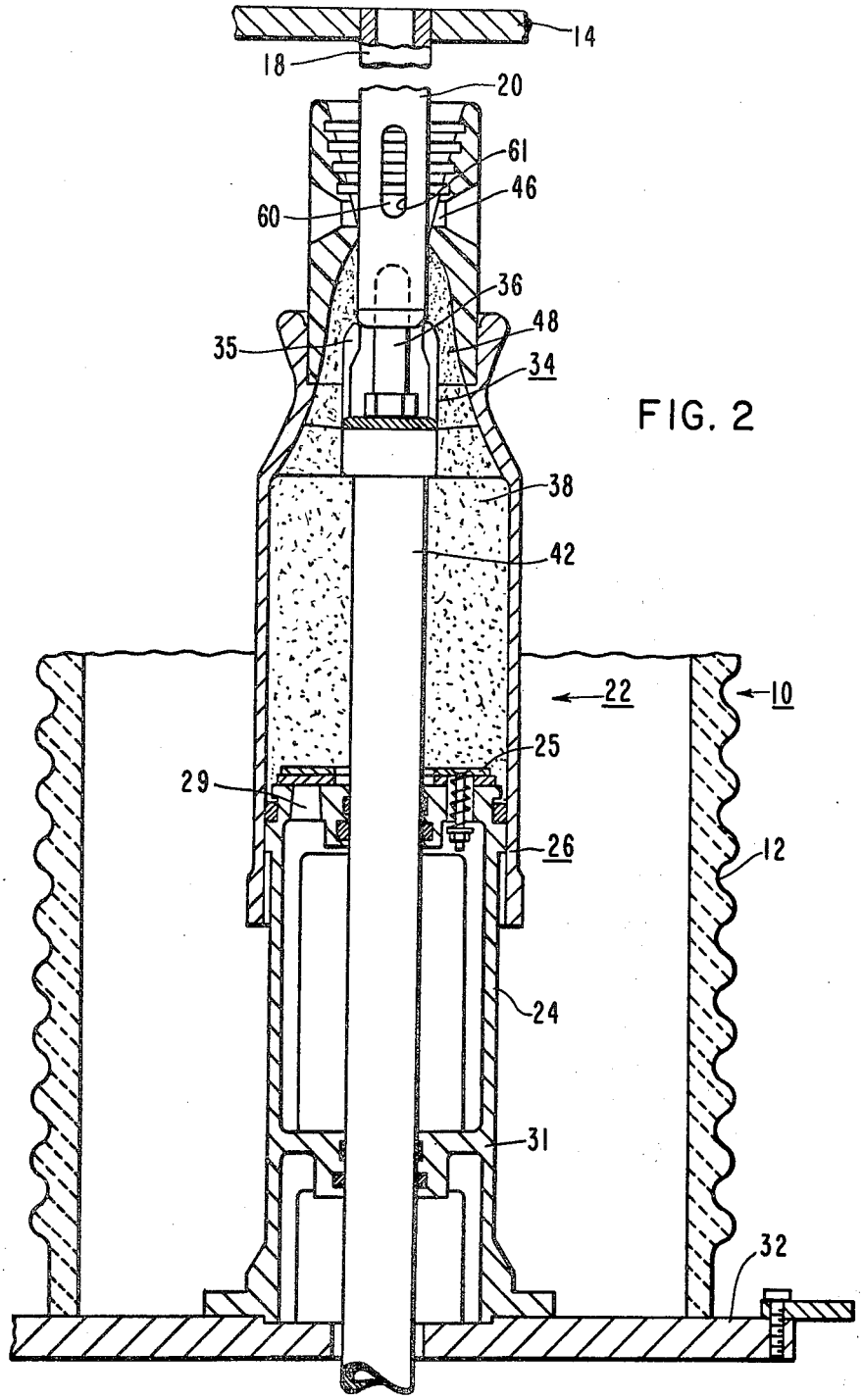
FIG. 2 is the same as FIG. 1 except the interrupter is shown in position just before the initial arc.
Figure 3:
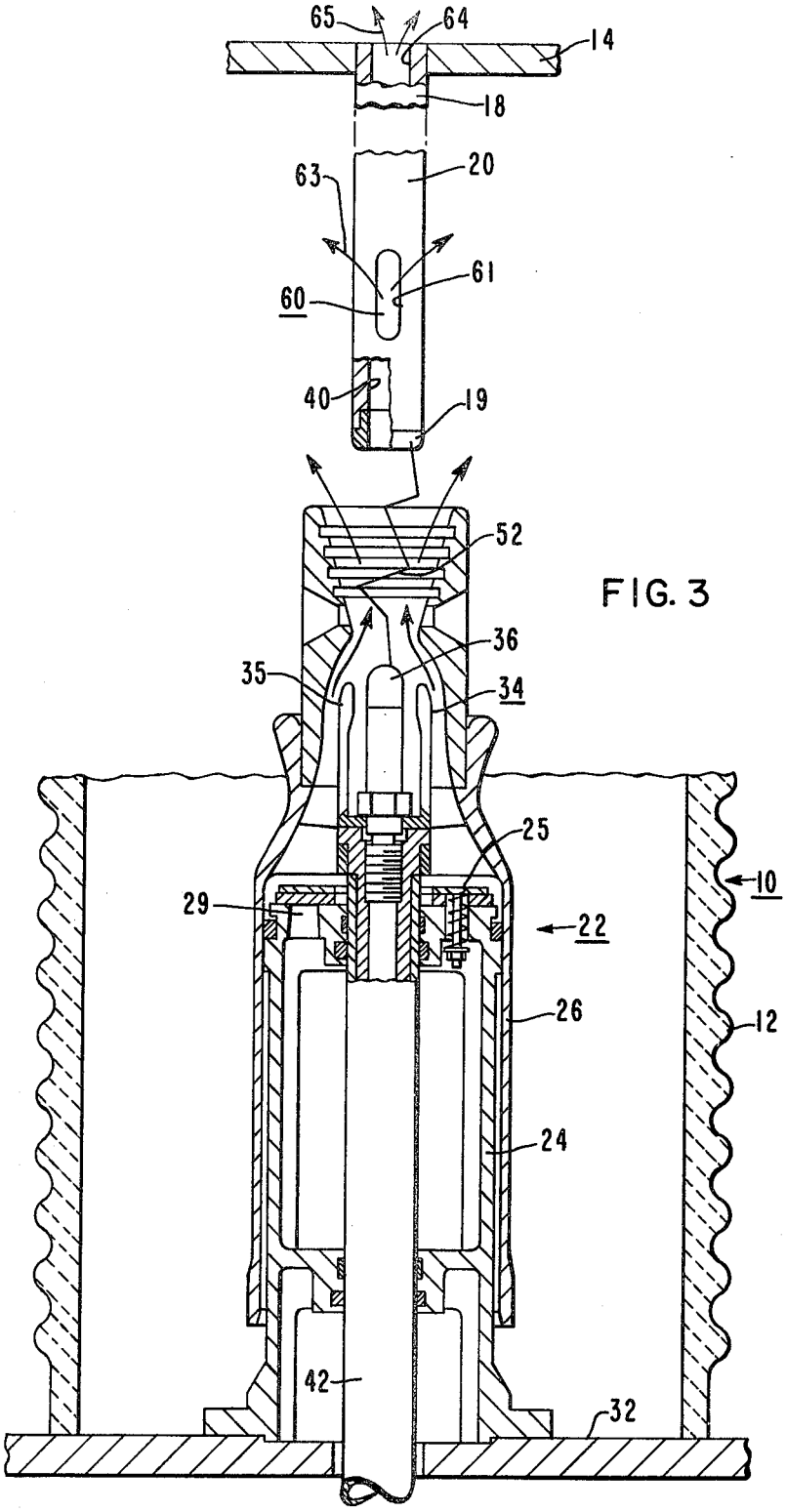
FIG. 3 is the same as FIG. 1 except that the interrupter is shown in the full open position.

Referring to FIGS. 1–3, there is shown a puffer-type compressed-gas circuit-interrupter 10 of the single-flow type. Such circuit interrupters 10 are characterized by enclosing within the interrupter an arc-extinguishing gas 11 typical of which is sulfur-hexafluoride ($SF_6$) gas. The interrupter 10 has an upstanding insulating casing structure 12, typically made of ceramic, which is provided at its upper end with a metallic cap portion 14 which is affixed to the casing structure 12 by bolts 16*a*, 16*b*. One of the bolts 16*a* supports line-terminal connection L1.

Affixed to the cap portion 14 and more particularly the support plate 13 is stationary contact structure means 18. The contact structure means 18 comprises a stationary tubular contact 20 having an arc-resistant material 19 such as copper-tungsten at the lower end 21 thereof. The interrupter 10 further includes gas compression means 22 comprising a piston means 24 and a cylinder means 26 movable relative to each other to compress gas 11 within the interior 38 of the cylinder means 26. The cylinder means 26 comprises a main cylinder member 28 slidably engageable with the piston means 24. The piston means 24 includes valve 25 and seal 27 which allows the gas pressure to equalize through aperture 29 between the interior 38 of the cylinder means and the interior 70 of interrupter when reclosing the interrupter. A hollow elongated insulating nozzle member 30 is affixed to the upper portion of the main cylinder member 28. The piston means 24 is supported by legs 31 on electrically conductive support plate 32.

A movable contact structure 34 comprises a movable main contact 35 and an interiorly-disposed arcing contact 36 in axial alignment with the tubular stationary contact 20. The movable contacts 35 and 36 are engageable with the stationary contact 20 when the interrupter 10 is in the closed position, see FIG. 1, and when the interrupter 10 is initially open, see FIG. 2, to restrict the flow of compressed gas from the interior 38 of the cylinder means 26 into the interior 40 of the stationary hollow contact 20 just before the initial arc is established. The movable contact structure 34 and the cylinder means 26 is supported by operating shaft 42 which may be fixedly connected to a rotative crank arm, for example, see the aforesaid U.S. Pat. No. 4,276,456. The movable contact structure 34 is electrically connected to the electrically conductive support plate 32 through the cylinder member 28 and the piston means 24. A second line terminal L2 is affixed by bolt 44 to the support plate 32.

The hollow nozzle member 30 has in the interior thereof a neck portion 46 of predetermined minimum diameter dependent on the rating of the interrupter 10, dividing the interior of the nozzle member 30 into a lower gas containment and guide section 48 and an upper exhaust section 50. The neck portion 46 of the nozzle member 30 is sized so as to engage the stationary contact 20 when the interrupter 10 is in the closed position and during the initial opening of the interrupter 10 to provide a partial hermetic seal for the gas containment and guide section 48 of the nozzle member 30 to contain the gas within the interior 38 of the cylinder means 26 until an arc is established. The lower gas containment and guide section 48 directs a blast of compressed gas 11 from the interior 38 of the cylinder means 36 into the arc 52, see FIG. 3, established between the stationary contact 20 and the movable arcing contact 36 upon their separation.

The stationary tubular contact 20 has venting aperture means 60 therein such as one or more slots 61 of a predetermined size such that the area encompassed by the slots 61 is preferably about three times the inside cross-sectional area of the tubular stationary contact 20. At least a portion of the venting aperture means 60 is within a predetermined axial section 62 of the stationary contact 20. The stationary contact axial section 62 is that portion of the contact 20 which is located within a length measured along the axis of the stationary contact 20 from the end 19 of the contact 20 up to three times the minimum inside diameter of the stationary contact 20. For example, the minimum inside diameter of the stationary tubular contact 20 shown in FIGS. 1–3 is typically 0.875 inch and thus the length of the axial stationary contact section 62 is equal to 2.63 inches. The axial stationary contact section 62 is adjacent to the neck portion 46 of the nozzle member 30 when the interrupter is closed, see FIG. 1.

Utilizing the present invention, the gas 11 which has been blasted into the arc 52 formed by the separation of the movable arcing contact 36 from the stationary contact 20 may exhaust with both radial flow 63 through the venting aperture means 60 and with axial flow 65 out the opening 64 at the top of the stationary contact 20, thereby eliminating any problem of stagnation of gas flow at the stationary contact 20. It has been found that the placement of the venting aperture means 60 is critical. If the venting aperture means 60 is outside the stationary contact axial section 62, very little interrupting improvement results compared to merely having the stationary contact 20 vented at the top. The present invention, by providing axial flow 63 through venting aperture means 60 located relatively closely to the bottom of the contact 20, that is, within the stationary contact axial section 62, results in a more efficient interrupter. Tests performed showed a fourteen percent reduction in minimum arcing time and required less than fifty percent of the required line side capacitance than a breaker without such predisposed aperture means 60. This reduction in the size of the line side capacitance alone will save several thousands of dollars cost for such an interrupter.

Figure 4:
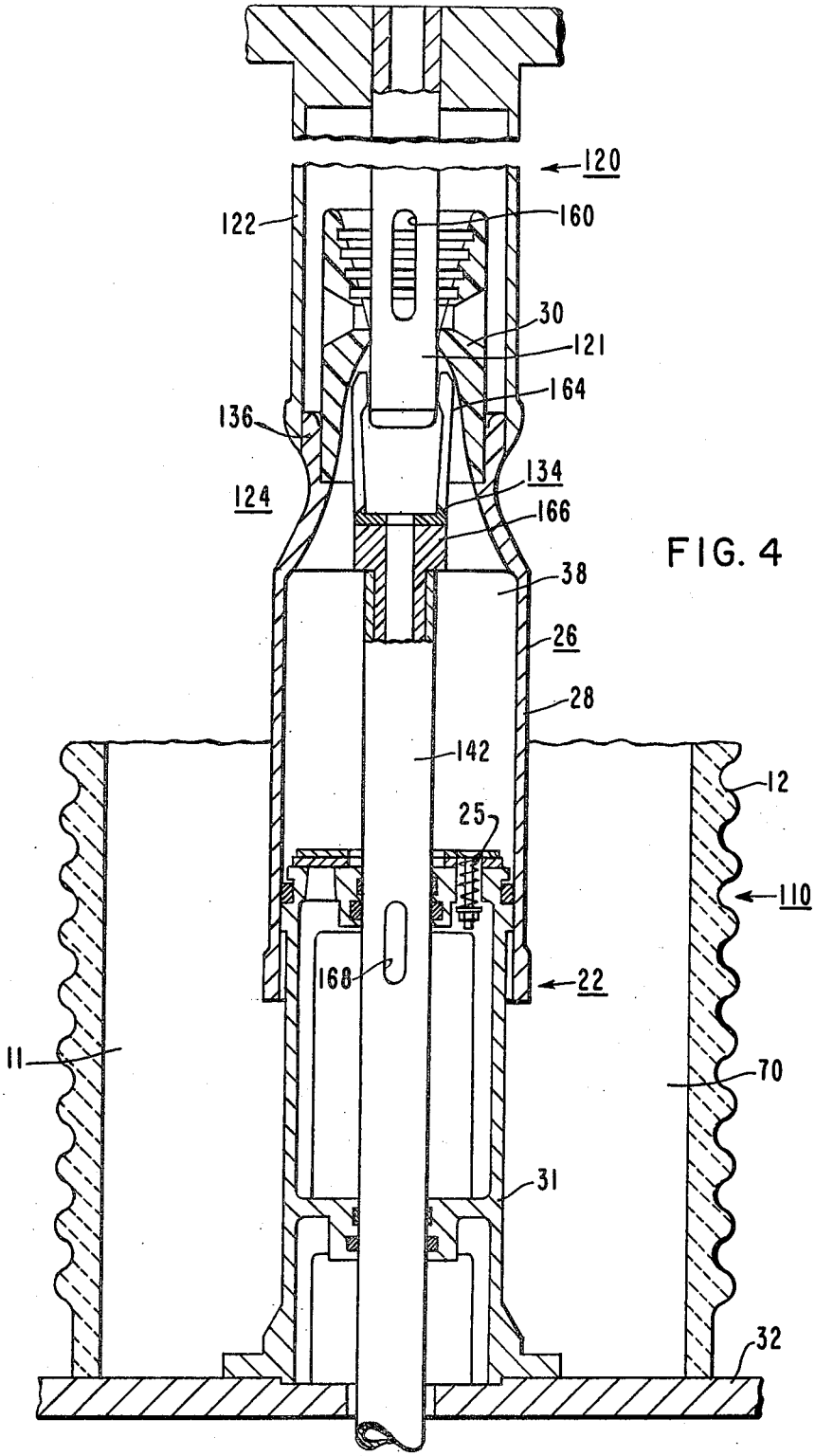
FIG. 4 shows a sectional elevational view of a double-flow puffer-type circuit-interrupter of the present invention in the closed position.
Figure 5:
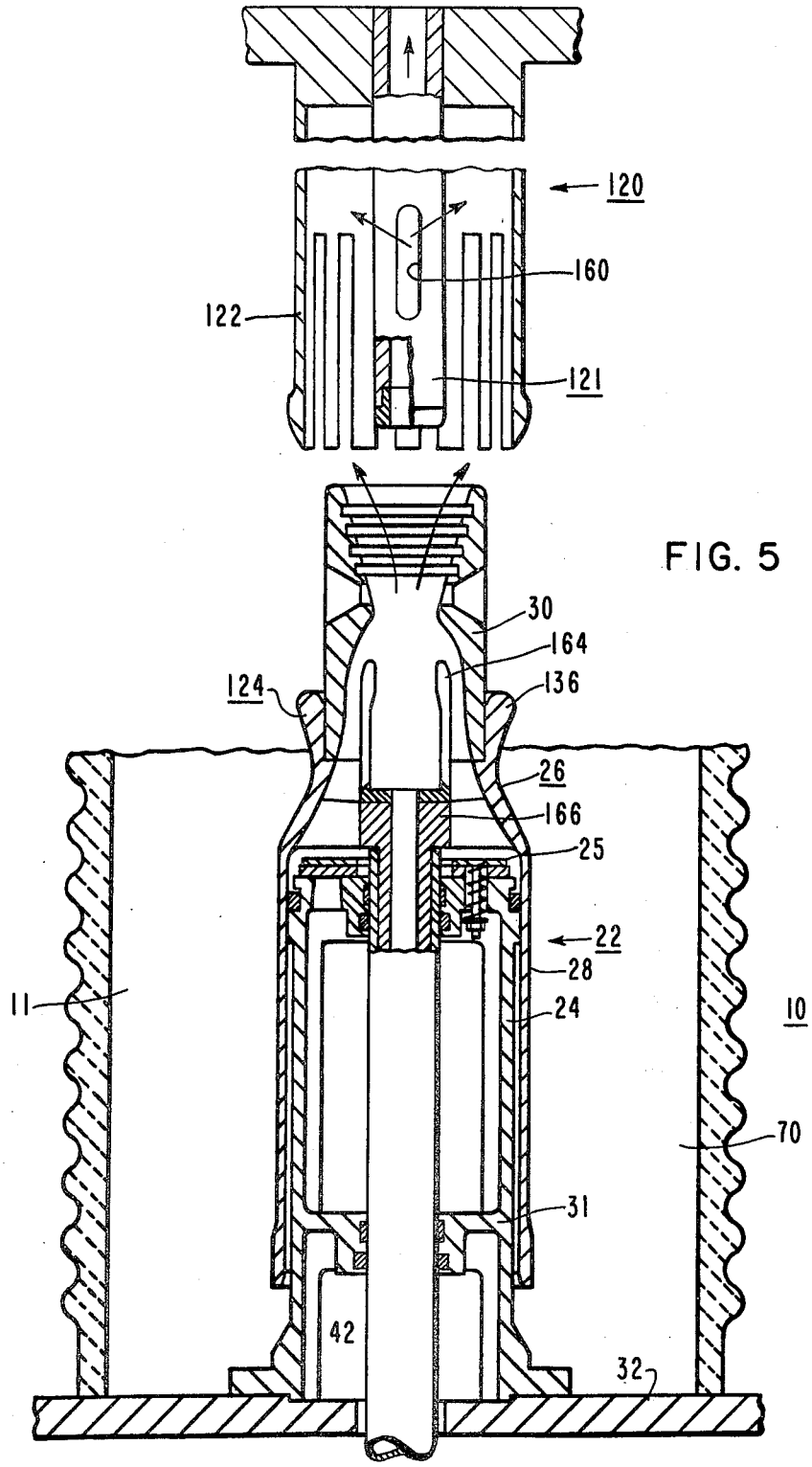
FIG. 5 is the same as FIG. 4 except that the interrupter is shown in the full open position.

The present invention may also be used in combination with a double-flow puffer-type compressed-gas circuit-interrupter as shown in FIGS. 4 and 5. The double-flow interrupter 110 is characterized by providing for the exhaustion of gas both upwardly towards the stationary contact structure 120 as in the previous embodiment, and downwardly through the movable contact structure 134. The movable contact structure 134 in this embodiment comprises a movable hollow arcing contact 164 in axial alignment with the stationary hollow arcing contact 121. The movable structure 134 also includes a movable main contact 136 which is aligned with and cooperatively engages the stationary main contact 122 in the closed position. The movable arcing contact 164 is mounted on base 166 which is screwed into the operating arm 142, see FIGS. 4 and 5. The operating arm 142 includes venting aperture 168 to allow the exhausted gas to exhaust from the movable arcing contact 164 and return to the interior 70 of the interrupter 110 externally of the cylinder 28. By providing the venting aperture means 160 in the stationary arcing contact 121 in the predisposed axial location in accordance with this invention, the same improvement in gas flow (see FIG. 5) through the contact 121 as for a single-flow interrupter will result for a double-flow interrupter.

I claim as my invention:

1. A puffer-type gas-insulated circuit interrupter comprising:

a hollow casing having an insulating gas disposed therein;

a hollow, tubular stationary contact having an inside diameter disposed within said casing, said stationary contact having an end thereof distal from said casing, said stationary contact having radial venting aperture means disposed therein at least a portion of which are disposed along said stationary contact within a region between the end of said stationary contact and a location up to three times said stationary contact inside diameter from said stationary contact end;

a movable contact structure cooperable with said stationary contact disposed within said casing and separable from said stationary contact to establish an arc therebetween during an opening operation;

gas compression means disposed in said casing for generating a blast of compressed gas during an opening operation, said gas compression means comprising a piston and a cylinder movable relative to each other to compress gas within the interior of said cylinder during an opening operation; and a hollowing elongated nozzle affixed to said cylinder and movable therewith, said nozzle in the interior thereof having a neck portion engaging said stationary contact during the initial portion of the opening operation to provide a partial sealing therebetween, said nozzle directing said blast of compressed gas into the arc established between said separating stationary and movable contacts during the later portions of the opening operation.

2. The circuit interrupter according to claim 1 wherein the engagement of said movable contact structure with said stationary contact during the initial portion of an opening operation restricts the flow of compressed gas from the interior of said cylinder into the interior of said hollow stationary contact.

3. The circuit interrupter according to claim 1 wherein said nozzle neck portion engages said stationary contact within said stationary contact region between the end of said stationary contact and a location about three times said stationary contact inside diameter from said stationary contact end when said interrupter is in the closed position.

4. The circuit interrupter according to claim 1 wherein said movable contact structure comprises a solid movable arcing contact and a plurality of surrounding movable main finger contacts both cooperable with said stationary contact.

5. The circuit interrupter according to claim 1 wherein said movable contact structure includes a hollow movable arcing contact vented externally of said cylinder.

6. The circuit interrupter according to claim 1 wherein said stationary contact includes an axial opening therein distal from said stationary contact end whereby gas within said stationary contact during an opening operation can exhaust therefrom both axially and radially.

7. The circuit interrupter according to claims 1, 2, 3, 4, 5 or 6 wherein said venting aperture means encompasses an area three times the inside cross-sectional area of said stationary contact.

* * * * *